United States Patent [19]

Grogan et al.

[11] 3,995,346

[45] Dec. 7, 1976

[54] ROTARY BRUSH

[75] Inventors: John E. Grogan, Toledo; Gerard A. Parseghian, Sylvania, both of Ohio

[73] Assignee: Power Brush Inc., Toledo, Ohio

[22] Filed: Apr. 4, 1975

[21] Appl. No.: 565,051

Related U.S. Application Data

[63] Continuation of Ser. No. 470,230, May 15, 1974, abandoned.

[52] U.S. Cl. ..... 15/182; 300/21

[51] Int. Cl.[2] ..... A46B 13/00; A46B 15/00

[58] Field of Search ..... 15/179–200; 300/21

[56] References Cited

UNITED STATES PATENTS

| | | | |
|---|---|---|---|
| 3,056,986 | 10/1962 | Bongiovanni et al. | 15/182 |
| 3,107,381 | 10/1963 | Tilgner | 15/182 |
| 3,763,516 | 10/1973 | Welter | 15/182 |

*Primary Examiner*—Peter Feldman
*Attorney, Agent, or Firm*—Donald R. Bahr

[57] ABSTRACT

This invention is concerned with a superior rotary brush wherein an elongated brush member is coiled in a helical fashion around a central shaft or cylinder which incorporates a plurality of projections on its outer periphery. The elongated brush member is bent around the projections of said shaft or cylinder in such a fashion that its inner periphery is non-arcuate. The inner periphery of said elongated brush member forms a plurality of cords which generally circumscribe the central shaft or cylinder. In use the inner periphery of the elongated brush member engages the projections as are contained on the central shaft or cylinder in such a manner that movement of the elongated brush member in relation to central shaft or cylinder is prevented.

The subject invention is particularly advantageous in that the forces which result from the engagement of the brush filament of the elongated brush member with a work piece are transmitted directly to the elongated shaft or cylinder and not to the fasteners whereby said elongated brush member is attached to said elongated shaft or cylinder.

15 Claims, 12 Drawing Figures

FIG. 2
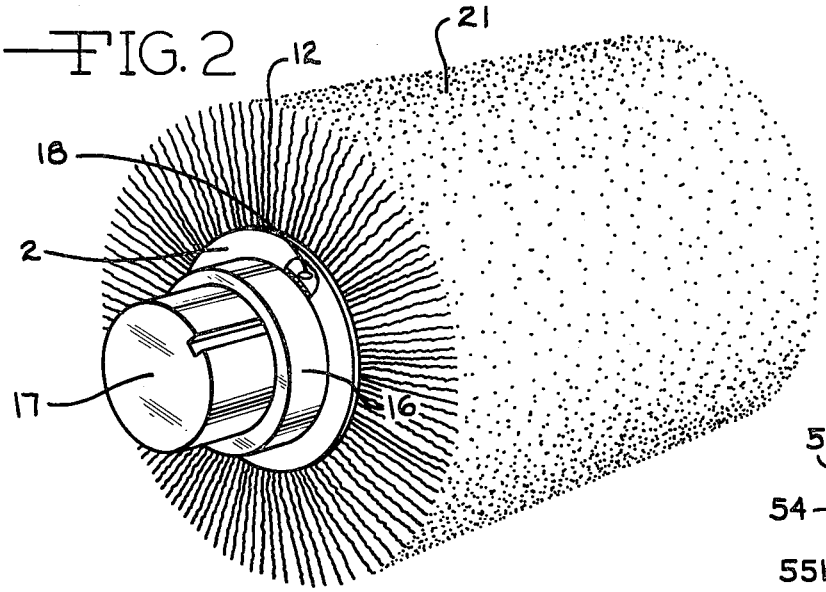
FIG. 11
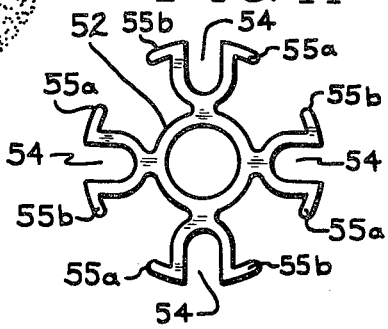
FIG. 3
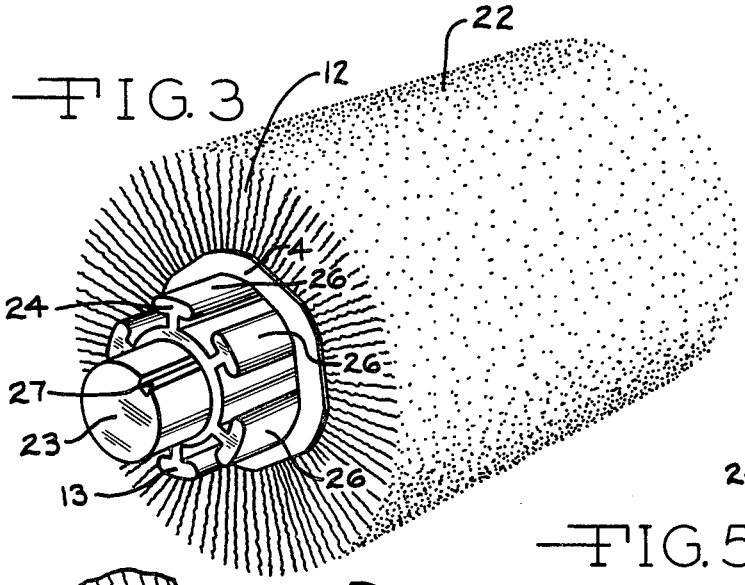
FIG. 5
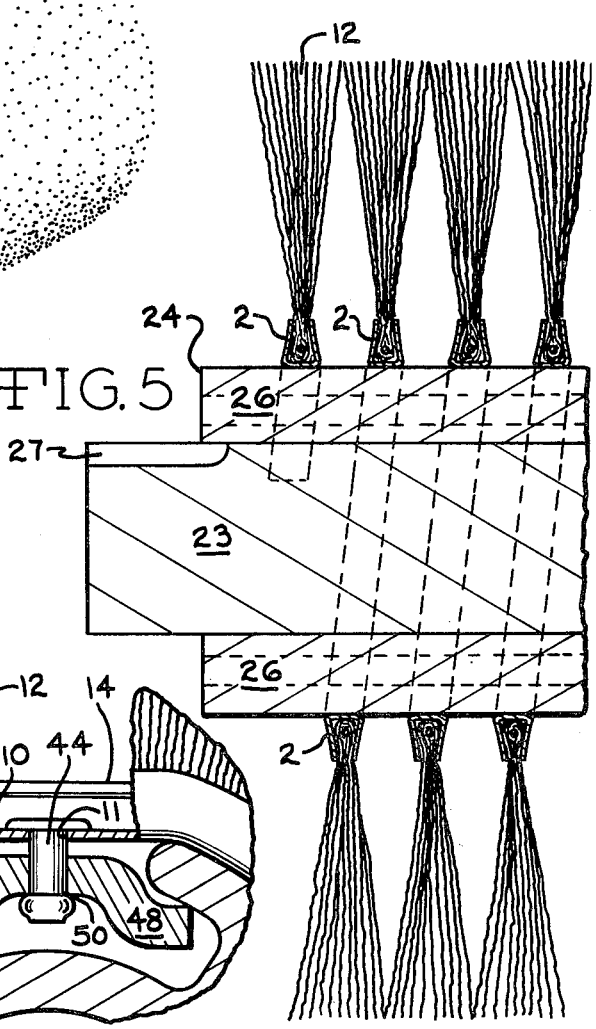
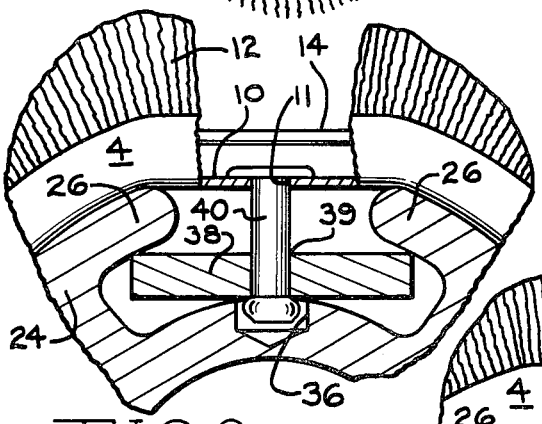
FIG. 6
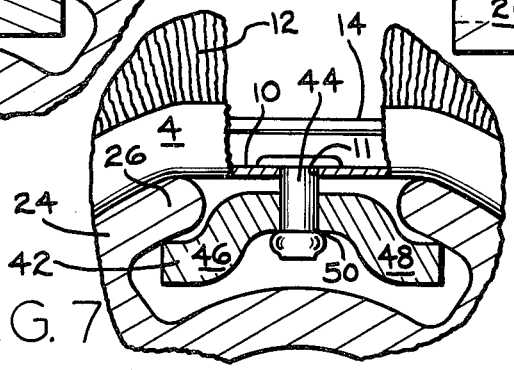
FIG. 7

ROTARY BRUSH

REFERENCE TO PRIOR APPLICATIONS

This application is a continuation application of Ser. No. 470,230 filed May 15, 1974, now abandoned.

BACKGROUND OF THE INVENTION

Elongated brush members, which generally comprise a U-shaped channel in which is positioned an elongated strand of brush filaments, are common in the prior art. These elongated brush members can be subsequently formed or attached to other members in such a manner that almost an unlimited variety of brushes may result. In one form these elongated brush members may be coiled in a helical fashion around a central shaft or cylinder to form a rotary brush. Rotary brushes of this type are very useful in many industrial applications. This invention is concerned with this general type of brush.

Brushes of the type mentioned above wherein an elongated brush member is coiled around a central shaft or cylinder in a helical fashion have a severe shortcoming in that the forces exerted on the brush filament in use tend to be transferred to the fasteners whereby the elongated brush member is attached to the central shaft or cylinder. As a result of this force transfer, the fasteners must be over engineered and further if one of the fasteners fails, the brush becomes totally inoperative.

The problem as described above results from the fact that the frictional contact between the shaft or cylinder and the elongated brush member is minimal. As a result of the subject invention, the frictional contact between the elongated brush member and the central shaft or cylinder is increased to a point whereby forces are no longer readily transferred from the brush filaments to the fasteners.

In the prior art, the elongated brush member is attached at each of its ends to the central shaft or cylinder. Accordingly, if one fastener fails the elongated brush member uncoils in such a fashion that the brush becomes inoperative. Further, this failure often causes damage to related equipment when free brush components become engaged therein. Finally, the brush failure as described above can cause severe injury to persons working in the vicinity of said brush. The problems and risks discussed above are eliminated by the use of the subject invention.

Accordingly, it is an object of this invention to provide a superior rotary brush wherein the brushing force is transmitted directly to the central shaft or cylinder and not to the fasteners whereby the brush member is attached to said central shaft or cylinder.

A further object of this invention is to provide a rotary brush which is unlikely to become disassembled by failure of the means whereby the brush member is attached to a central shaft or cylinder.

These and other objects of the invention will become apparent from the following description when taken in conjunction with the drawings wherein:

DESCRIPTION OF THE DRAWINGS

FIG. 2 is an end view of a complete brush assembly, in accordance with this invention;

FIG. 3 is an end perspective view of a complete brush assembly in accordance with this invention;

FIG. 5 is a sectional view of a brush assembly in accordance with this invention taken along lines 3—3 of FIG. 4;

FIG. 6 is a broken away end view of a fastening means suitable for use in this invention;

FIG. 7 is a broken away view of still another fastening means suitable for use in this invention;

FIG. 11 is an end view of another embodiment of a cylinder for use in this invention.

DESCRIPTION OF THE PREFERRED EMBODIMENT

Figure 1:
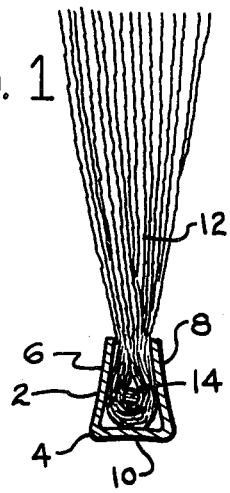
FIG. 1 is a cross-sectional view of a typical prior art elongated brush member.

Referring specifically to FIG. 1, it can be seen that elongated brush member 2 comprises a generally U-shaped or channel shaped backing 4 having a pair of opposing side sections 6 and 8, and a bottom section 10. In the preferred embodiment channel-shaped backing 4 is U-shaped. Positioned in brush backing 4 is a filament member 12 which may likewise be U-shaped.

Filament member 12 is secured in brush backing 4 by means of wire 14. In manufacture after filament member 12 is placed in brush backing 4, the side sections 6 and 8 and wire 14 are crimped in such a manner that the composite structure is secured together. It can be seen that brush member 2 can be readily formed in extended or continuous lengths. Referring to FIG. 2, in the manufacture of rotary brushes of the type with which this invention is concerned, a length of brush member 2 is wound in a helical fashion around a cylinder 16 and secured at either end by a pair of fasteners 18 to produce a finished rotary brush 21. Rotary brush 21 is connected to a power source by means of a pair of shafts 17. Rotary brushes such as brush 21 are common in the prior art and have achieved widespread industrial acceptance. It is understood that FIG. 2 illustrates one end only of rotary brush 21. Therefore, only one shaft 17 and one fastener 18 is illustrated. Fastener 18 can be of any suitable form such as a rivet or screw.

It can be seen further from FIGS. 1 and 2 that the movement of brush backing 4 with respect to cylinder 16 is to a great degree controlled by the frictional contact of bottom section 10 of the brush backing 4 with the outer periphery of cylinder 16. Hence, when rotary brush 21 is rotated, forces which result from the contact of filament member 12 with a work piece are readily transferred to fasteners 18. Further, it can be readily seen that if either of fasteners 18 should fail, composite rotary brush member 22 will spin off cylinder 16.

The problem of the prior art structure as is illustrated in FIG. 2 is overcome by the improved rotary brush structure 13 which is illustrated in FIG. 3. In FIG. 3 it can be seen that the outer periphery of cylinder 24 incorporates a plurality of T-shaped projections 26 over which brush backing 4 is stressed and bent. As a result of this stressing and bending, bottom section 10 of brush backing 4 is no longer arcuate but instead comprises a plurality of planar chords which interconnect to circumscribe the outermost edges of T-shaped projections 26. Brush backing 4 is secured in place with fastener 39.

Figure 4:
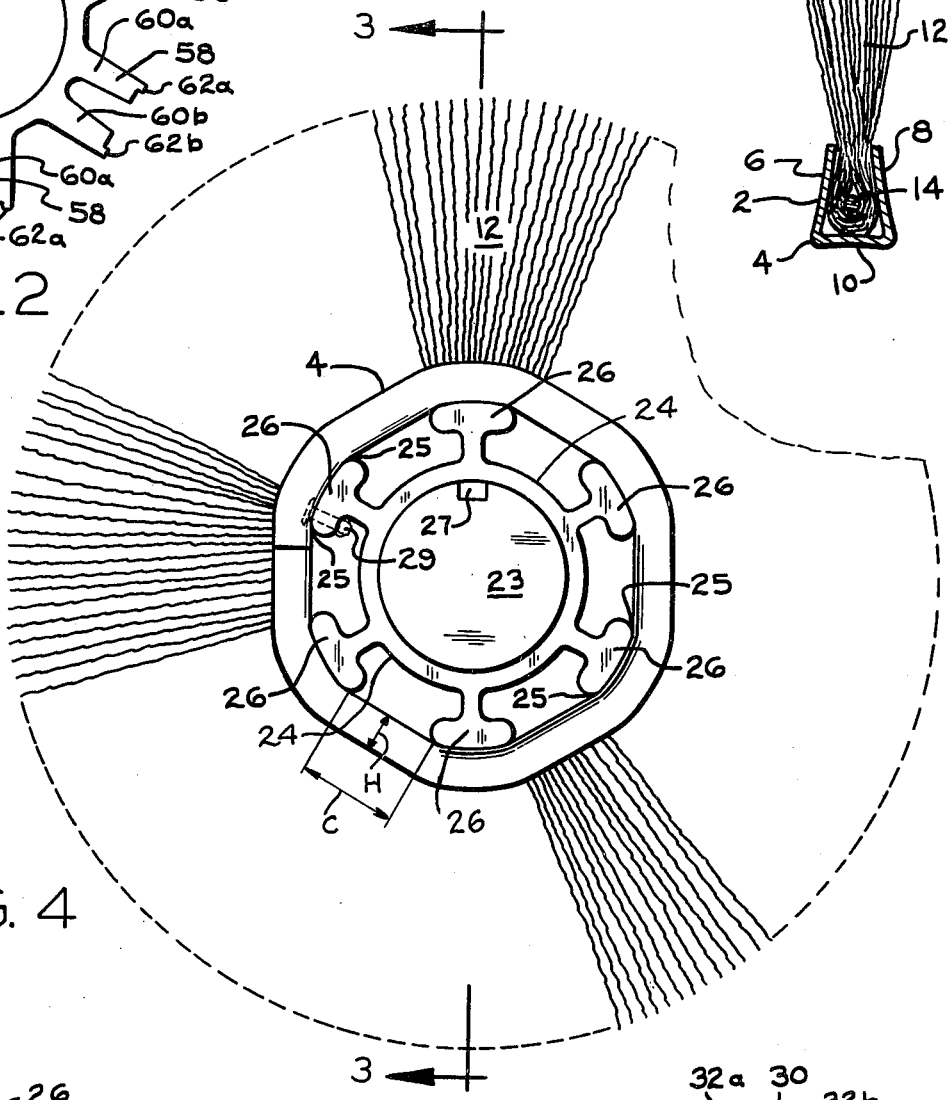
FIG. 4 is an end view of a brush assembly in accordance with this invention.

The non-arcuate nature of brush backing 4 is further illustrated in FIG. 4. From a further examination of FIG. 4 it can be seen that in the area between projections 26, brush backing 4 is unsupported. It is readily understood by one skilled in the art that the structural integrity of brush backing 4 must be such that it does not collapse when the desired load is placed on filament member 12 when useful work is performed by rotary brush 22.

Referring again to FIGS. 3 and 4, during manufacture brush backing 4 is stretched and bent over projections 26. There is very strong frictional engagement between projections 26 at points 25 and the bottom section 10 of brush backing 4. This frictional engagement may be further enhanced when projections 26 are formed from a metal of different hardness from that which brush backing 4 is formed. In practice it has been found highly desirable to form cylinder 24 and hence projections 26 from aluminum while forming brush backing 4 from steel. With this combination brush backing 4 cuts into projections 26 at points 25 in such a manner that the frictional engagement between projections 26 and brush backing 4 is greatly enhanced.

FIG. 5 illustrates a cross section of the completed rotary brush of this invention. The cross sectional view was taken along line 3—3 of FIG. 4. To form a complete rotary brush, a continuous length of brush member 2 is wrapped in a helical fashion around cylinder 24 with projections 26 being in abutting contact with bottom section 10 of brush backing 4. Brush members 2 are illustrated in a non-adjacent, spaced apart, relationship with each other such that side sections 6 and 8 do not abut with each other. This is a preferred embodiment of this invention. It is understood by one skilled in the art that a rotary brush having any desired filament surface area can be produced by varying the spacing of brush member 2 along T-shaped projections 26 of cylinder 24.

As is shown in FIGS. 4 and 5, rotary brush 22 of this invention is assembled in such a fashion that a drive shaft 23 is attached to cylinder 24. Drive shaft 23 permits an engagement with a power source. A key way 27 is provided in drive shaft 23. Drive shaft 23 may be attached to cylinder 24 by any convenient means such as by crimping cylinder 24 around the periphery of drive shaft 23. Each end of cylinder 24 is provided with a drive shaft 23. Both of these drive shafts may be connected to a power source as in a more common arrangement one end is driven by a power source while the other rests in a suitable bearing not illustrated. The use of a pair of opposing shaft members as is illustrated in FIGS. 3 and 4 and as is described above is advantageous in that the complex shape of cylinder 24 or its equivalent can be formed by any convenient means such as by extrusion. These extrusions can be found in extended lengths and cut to any desired length to form a rotary brush section. In forming these extrusions there is no need to provide a means for attachment to a power source.

Further, this arrangement is advantageous as by having drive shafts 23 only on the ends of cylinder 24, the mass of the composite rotary brush is reduced hence reducing the power requirements necessary to overcome inertia during startup. Further, the structural integrity of the overall composite rotary brush 22 is increased as mass is removed from the axis of rotary brush 22. Instead the mass of rotary brush 22 is concentrated near outer periphery of rotary brush 22 so as to produce a stronger composite structure.

Means for use in accordance with this invention whereby brush backing 4 may be secured to cylinder 24 are illustrated in FIGS. 6 and 7. In the embodiment illustrated in FIG. 6, the bottom section 10 of brush backing 4 is provided with an aperature 11. Further, a blind hole 36 is drilled in cylinder 24. A plate 38 having an aperature 39 is further provided. Plate 38 is of such a length that it abuts against the underside of projections 26 but will not pass through the spacing between a pair of opposing projections 26. A blind rivet 40 is passed through aperatures 11 and 39 and drawn up in hole 36 such that the uppermost corners of plate 38 tend to bite into the underside of projections 26. It is desirable that plate 38 be harder than projections 26 to facilitate the biting of plate member 38 into the underside of T-shaped projections 26.

In the alternate embodiment as is illustrated in FIG. 7, a plate member 42 having a pair of opposing dog-legged sections 46 and 48 is provided. Plate 42 incorporates an aperature 50. A blind rivet is passed through aperatures 11 and 50 and secured such that the uppermost edge of plate 40 bites into the underside of projections 26 in the manner as described above. By the use of the embodiment of FIG. 7 the need for blind hole 36 as is discussed in connection with FIG. 6 is eliminated.

Rotary brush 22 of this invention may be assembled in a variety of ways. A preferred method for assembly is to chuck cylinder 24 in a winding lathe. The end of brush member 2 is then secured to projections 26 by means of an appropriate fastener such as is illustrated in FIGS. 6 and 7, the axis of brush member 2 being slightly angularly disposed to the normal axis of cylinder 24. Cylinder 24 is then rotated causing brush member 2 to wind around projections 26 in a helical fashion. Once a rotary brush of the desired length is produced brush member 2 is cut and secured to projections 26 on the opposite end of from the first attachment. Drive shafts 23 may be positioned in the ends of cylinder 24 before or after brush member 2 is wound around cylinder 24.

Figure 8:
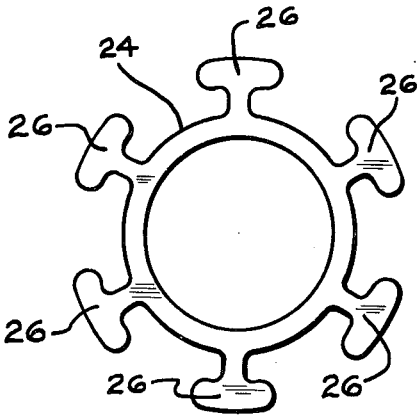
FIG. 8 is an end view of the cylinder for use in accordance with this invention as is illustrated in FIGS. 3 and 5.

With reference to FIGS. 8, 9, 10, 11 and 12, it can be seen that the central cylinder for use in this invention can take a variety of configurations. FIG. 8 illustrates cylinder 24 which is shown in the complete brush assembly of FIGS. 3, 4 and 5.

Figure 9:
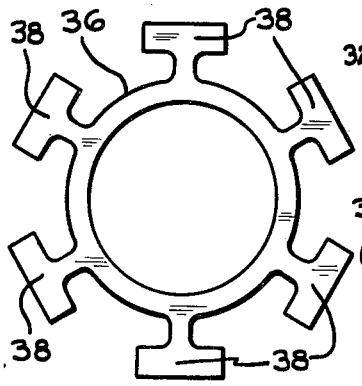
FIG. 9 is an end view of another embodiment of a cylinder for use in this invention.

From a comparison of FIGS. 8 and 9, it can be seen that projections 26 and 38 can assume a variety of configurations. Projections 38 of FIG. 9 have outwardly disposed right angles which tend to deform or crush when brush backing 4 is bent around cylinder 36.

Figure 10:
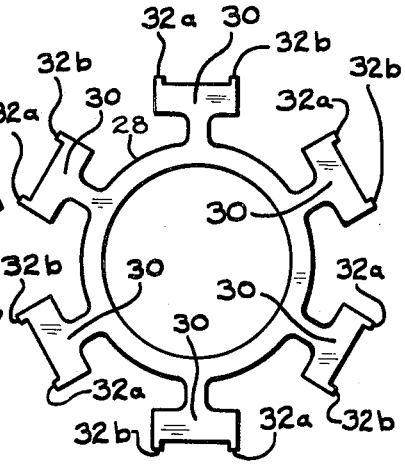
FIG. 10 is an end view of still another embodiment of a cylinder for use in this invention.

From an examination of FIG. 10 still another embodiment of a central cylinder for use in this invention can be seen. In this embodiment the outermost surface of cylinder 28 incorporates a plurality of projections 30. Each projection in turn incorporates a pair of opposing teats **32*a* and 32*b*. These teats are rather fragile hence during manufacture when brush backing 4 is stressed and bent around projections 30, tests 32*a* and 32*b* are deformed or crushed. With this deformation or crushing, the frictional engagement between brush backing 4 and projections 30 is greatly enhanced thereby preventing the lateral movement of the brush backing 4.**

Still another embodiment for a central cylinder for use in accordance with this invention is illustrated in FIG. 11 wherein cylinder 52 incorporates a plurality of U-shaped projections 54, each of which incorporates a pair of opposing legs 55*a* and 55*b*. When brush backing 4 is stressed and bent around opposing legs 55*a* and 55*b*, brush backing 4 tends to deform or crush opposing legs 55*a* and 55*b*.

Figure 12:
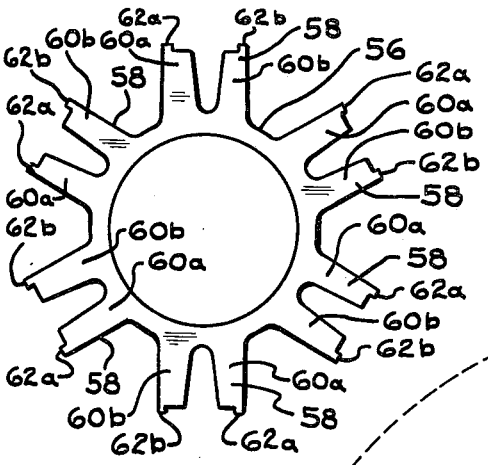
FIG. 12 is an end view of a cylinder embodiment for use in this invention.

Finally, FIG. 12 represents still another embodiment of a central cyliner for use in the subject invention. In this embodiment central cylinder 56 is provided with a plurality of projections 58. Each projection 58 comprises a pair of legs 60*a* and 60*b*. The outermost edges of legs 60*a* and 60*b* include teats 62*a* and 62*b* which are deformed or crushed when brush backing 4 is stressed and bent around central cylinder 56 in a manner similar to that described in connection with FIG. 10.

The number of projections which may be used on the central cylinder for use in this invention varies with the diameter of the central cylinder. Generally speaking the larger the diameter of the central cylinder, the more projections are needed. The number of projections should be such that the distance between the projections allows brush backing 4 to be unsupported over said distance considering the structural integrity of said brush backing. When the diameter of the central cylinder is approximately 3 inches, 6 projections have been found to be a useful embodiment.

It is understood that when teats 32*a*, 32*b*, 62*a* and 62*b* are deformed or crushed, the movement of brush member 2 on the central cylinder is prevented. Further, brush member 2 can be bent around central cylinder 36 of FIG. 9 in such a manner that brush backing 4 digs into the corners of projections 38 thereby preventing the movement of brush member 2 on central cylinder 36. Finally, referring to FIG. 11, legs 55*a* and 55*b* can be designed with a wall thickness such that they are deformed or crushed when brush member 2 is bent around central cylinder 52. From this discussion it can be seen that the invention is adapted to using a wide variety of central cylinders which incorporate deformable or crushable sections.

Referring to FIG. 4 the height H of brush backing 4 is shown in relation to the length of cord C. It has been found that in the preferred embodiment of this invention the relationship of height M to the length of cord C is critical.

As has been mentioned above the self-locking feature wherein the brush backing is secured to the central shaft without the benefit of fasteners is a significant advantage of the subject invention. This self-locking feature is optionized when the ratio of H/C falls within certain specified ranges.

Generally, it can be said that the self-locking feature is lost when the length of cord C is more than 2H.

In accordance with the preferred aspects of this invention the broad range H/C is from about 1.0 to 2.0. The preferred range for H/C is from about 1.0 to 1.5. The most preferred ratio of H/C is about 1.4.

It is understood by one skilled in the art that the ratio of H/C will vary with the yield strength of the material from which the brush backing is formed. The ranges as given above apply when the brush backing is formed from materials with a yield strength of 50,000 to 60,000 lbs. per square inch. The formation of chords C gives the resultant structure radial integrity; that is, the formation of these chords prevents the brush backing from springing outwardly in a plane at right angles to the axis of the central shaft or cylinder. Stability or structural integrity in a plane parallel with the axis of the central shaft or cylinder is achieved when the brush backing deforms the projections of said central shaft or cylinder in a manner as described above.

Further it should be noted that the number of projections that can be put on a cylinder is related to the circumference of the cylinder as if a large number of projections are put on a small diameter cylinder the cord length is insufficient to allow bending.

In accordance with the preferred aspect of this invention, the inner surface of said elongated brush member deforms the outer surface of the projections against which it is biased. In order to effect this deformation it is preferred that the projections of the central cylinder and the inner surface of the elongated brush member be formed from different materials, such that there is a hardness difference.

In the preferred embodiment the brush backing is formed from a material which is harder than the central cylinder. In the most preferred aspect of this invention, the brush backing is formed from steel while the central cylinder and hence the projections are an aluminum extrusion. While aluminum extrusions are preferred for use as central cylinders in accordance with this invention said shafts can be formed from other soft materials such as copper, bronze, brass, etc. Likewise while it is preferred that the central cylinders be formed by extrusion, it is understood by one skilled in the art that the central cylinder can be a unitary cylinder such as a casting. In this application the term unitary cylinder includes both castings and extrusions, said extrusions may be made from any extrudable material such as soft metals or polymeric materials.

The above description and drawings are illustrative only. The scope of the present invention is to be limited only by the following claims.

We claim:

1. A rotary brush comprising a central unitary cylinder, which is an extrusion, having a plurality of outwardly extending integral projections and an elongated brush member, having a channel-shaped backing, which is bent, biased, and wound around the projections of said central unitary cylinder, to such a degree that the backing of said elongated brush member, bites into and inwardly deforms said projections, the backing of said elongated brush member being non-arcuate in relation to the circumference of said projection and harder than said outwardly extending projections, wherein movement of the elongated brush member parellel to the axis of said unitary cylinder is prevented.

2. The rotary brush of claim 1 wherein said elongated brush member comprises a U-shaped brush backing in which is positioned a filament member.

3. The rotary brush of claim 1 wherein said elongated brush member is wound around said central shaft in a helical fashion.

4. The rotary brush of claim 2 wherein said elongated brush member is wound around said central shaft in a helical fashion.

5. The rotary brush of claim 1 wherein said elongated brush member is wound around said central shaft in a helical fashion the sides of said elongated brush member being in an abutting relationship with each other.

6. The rotary brush of claim 2 wherein said elongated brush member is wound around said central shaft in a helical fashion the sides of said elongated brush member being in an abutting relationship with each other.

7. The rotary brush of claim 1 wherein said elongated brush member is wound around said central shaft in a helical fashion the sides of said elongated brush member being in a spaced apart relationship with each other.

8. The rotary brush of claim 2 wherein said elongated brush member is wound around said central shaft in a helical fashion the sides of said elongated brush member being in a spaced apart relationship with each other.

9. The rotary brush of claim 1 wherein said projections incorporate at least one deformable section.

10. The rotary brush of claim 2 wherein said projections incorporate at least one deformable section.

11. The rotary brush of claim 2 wherein said central cylinder incorporates six T-shaped projections having rounded edges; said rotary brush being further provided with a plate member which is adopted to fit between opposing pairs of said T-shaped projections, said elongated brush member being secured to said central cylinder by a fastener which biases said elongated brush member against the outer edge of said T-shaped projections and said plate member against the underside of said T-shaped projections.

12. A rotary brush comprising a central unitary cylinder, which is an extrusion, having a plurality of outwardly extending integral projections and an elongated brush member, having a channel-shaped backing, which is bent, biased, and wound around the projections of said central unitary cylinder, to such a degree that the backing of said elongated brush member, bites into and inwardly deforms said projections, the backing of said elongated brush member being non-arcuate in relation to the circumference of said projection and harder than said outwardly extending projections, wherein movement of the elongated brush member parallel to the axis of said unitary cylinder is prevented, wherein the ratio of H/C is less than 2, where H is the height of said channel - shaped backing and C is the length of the non-arcuate portion of said brush backing between said projections.

13. The rotary brush of claim 12 wherein the ratio of H/C is from about 1.0 to 2.0.

14. The rotary brush of claim 12 wherein the ratio of H/C is from about 1.0 to 1.5.

15. The rotary brush of claim 12 wherein the ratio of H/C is 1.4.

* * * * *